US007100975B1

(12) United States Patent
Zheng

(10) Patent No.: US 7,100,975 B1
(45) Date of Patent: Sep. 5, 2006

(54) COLLAPSIBLE ROCKING CHAIR

(75) Inventor: Edward Zheng, Chino Hills, CA (US)

(73) Assignee: Tofasco of America, Inc., LaVerne, CA (US)

( * ) Notice: Subject to any disclaimer, the term of this patent is extended or adjusted under 35 U.S.C. 154(b) by 0 days.

(21) Appl. No.: 10/363,362

(22) PCT Filed: Aug. 30, 2000

(86) PCT No.: PCT/US00/23989

§ 371 (c)(1),
(2), (4) Date: Oct. 2, 2003

(87) PCT Pub. No.: WO02/17750

PCT Pub. Date: Mar. 7, 2002

(51) Int. Cl.
*A47C 3/02* (2006.01)

(52) U.S. Cl. ..... 297/32; 297/271.6; 297/45

(58) Field of Classification Search ..... 297/16.1, 297/16.2, 35, 42, 45, 46, 271.5, 271.6, 258.1, 297/32, 272.1, 31, 39, 40, 43, 44, 55, 56, 297/29, 33, 378.1, 133, 131, 132, 143, 259.1
See application file for complete search history.

(56) References Cited

U.S. PATENT DOCUMENTS

| | | | | | |
|---|---|---|---|---|---|
| 166,733 | A | * | 8/1875 | Vail | 297/18 |
| 207,312 | A | * | 8/1878 | Smith | 297/32 |
| 244,104 | A | * | 7/1881 | Andrews | 297/133 |
| 248,312 | A | * | 10/1881 | Hayes | 297/32 |
| 333,273 | A | * | 12/1885 | Achenbach | 297/20 |
| 405,919 | A | * | 6/1889 | Straus et al. | 297/133 |
| 870,260 | A | * | 11/1907 | Thomas | 297/18 |
| 971,704 | A | * | 10/1910 | Swindler | 280/218 |
| 1,341,225 | A | * | 5/1920 | Clough | 297/45 |
| 3,114,572 | A | | 12/1963 | Hopkins | |
| 3,124,387 | A | | 3/1964 | Maclaren | |
| 4,047,753 | A | * | 9/1977 | Uchida | 297/32 |
| 4,126,353 | A | * | 11/1978 | Clough | 297/133 |
| 4,685,725 | A | | 8/1987 | Helfrich | |
| 4,715,650 | A | | 12/1987 | Berman et al. | |
| 4,807,926 | A | | 2/1989 | Brunn | |
| 5,058,950 | A | | 10/1991 | Mann | |
| 5,560,675 | A | * | 10/1996 | Altheimer et al. | 297/33 |
| D380,633 | S | | 7/1997 | Shaw | |
| 5,702,152 | A | | 12/1997 | Shaw | |
| 5,893,605 | A | * | 4/1999 | Chang | 297/188.14 |
| 5,984,406 | A | * | 11/1999 | Lee | 297/16.2 |
| 6,082,813 | A | * | 7/2000 | Chen | 297/16.2 |
| 6,174,028 | B1 | * | 1/2001 | Yang et al. | 297/258.1 |
| 6,439,656 | B1 | * | 8/2002 | Liu | 297/33 |

* cited by examiner

*Primary Examiner*—Milton Nelson, Jr.
(74) *Attorney, Agent, or Firm*—Rutan & Tucker, LLP

(57) ABSTRACT

Methods and apparatus are provided in which a collapsible rocking chair has legs that translate towards and away from each other to configure the chair between open and collapsed dispositions, and at least one leg that slidably articulates with a rocker. Preferred embodiments have four legs. The left back leg slidably articulates with a left rocker, and the right back leg slidably articulates with a right rocker. The front legs are pivotally coupled to the respective rockers at fixed points. The back frame is preferably coupled to the left and right legs at pivots, allowing the back to approximate the seat during folding. Both back and seat are preferably formed from a fabric material, and more preferably from a single continuous piece of fabric. Preferred rocking chairs also include left and right armrests, supported at least in part by the back frame.

18 Claims, 3 Drawing Sheets

FIG. 4
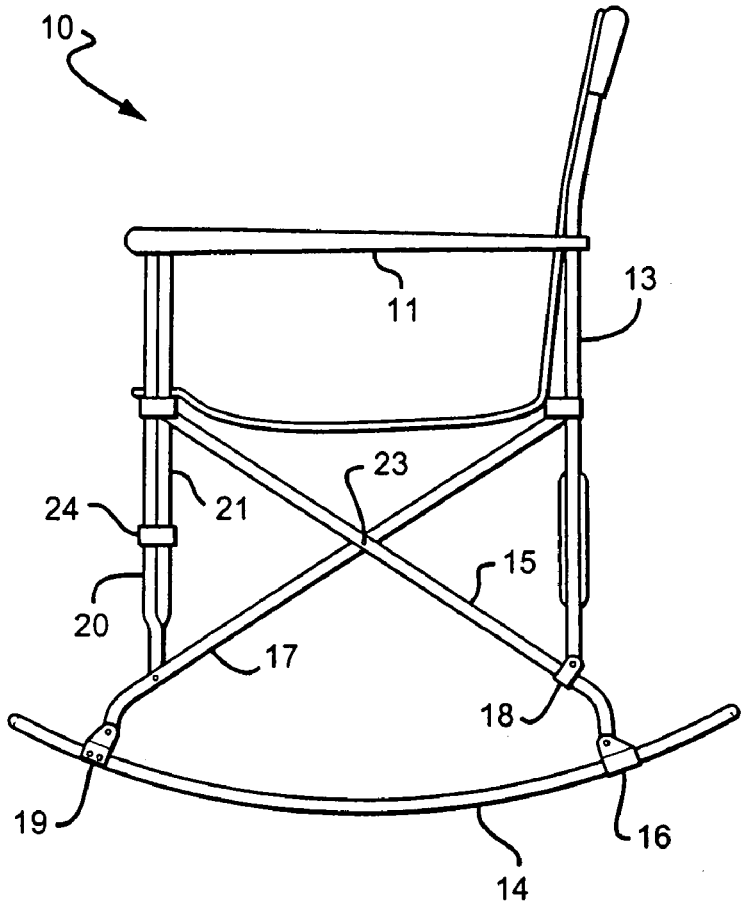
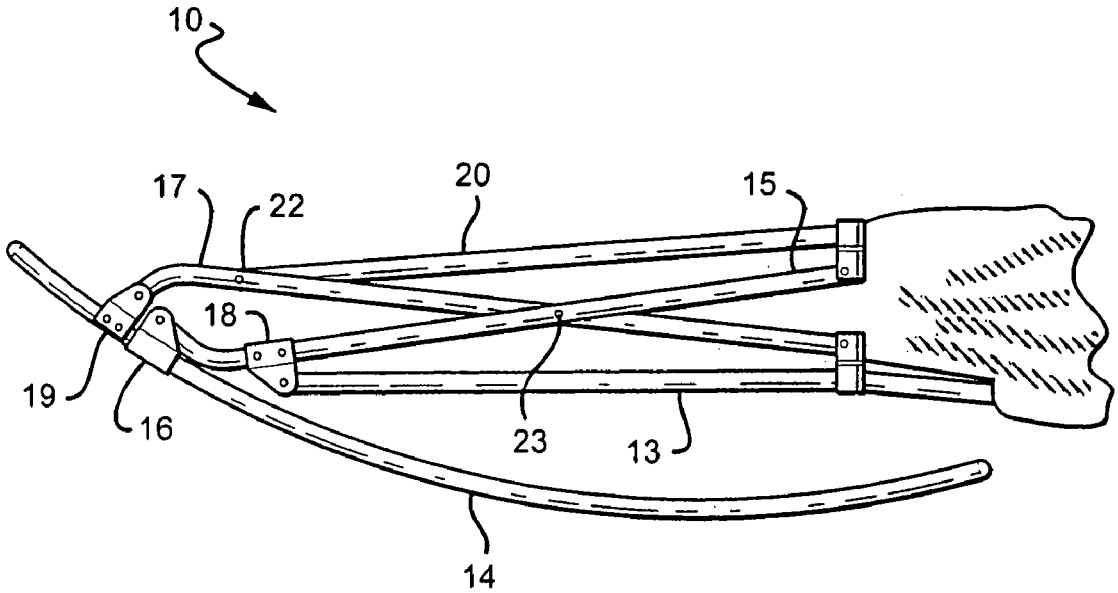
FIG. 5

COLLAPSIBLE ROCKING CHAIR

FIELD OF THE INVENTION

The field of the invention is collapsible furniture.

BACKGROUND OF THE INVENTION

Folding chairs have been known for many years, if not centuries. The distinguishing feature is that the chair can be manipulated between a folded disposition in which the back is pivoted to approximate the seat, and an open disposition in which the back is disposed more or less perpendicular to the seat.

Many different types of folding chairs are known, including rocking chairs. U.S. Pat. No. 4,807,926 to Brunn (February 1989), for example, depicts a folding rocking chair in which the back legs are pivoted against the rockers, and the front legs slide along the rockers towards the back leg/rocker pivots to approximate the seat and legs to the rockers. The folding rockers of U.S. Pat. No. 5,702,152 (December 1997) and Des 380633 (July 1997), both to Shaw, provide legs that are releasably engaged with the respective rockers, and that mate with channels to provide a sliding relationship among the legs. U.S. Pat. No. 3,114,572 to Hopkins (December 1963) depicts a folding rocking chair in which the back legs are fixed in position with respect to the rockers, and front legs that are pivotally disposed with respect to the rockers.

More recently collapsible chairs have gained widespread attention. Collapsible chairs are different from folding chairs in that the legs can be manipulated to approximate each other in close parallel or substantially parallel relationship. The back may optionally fold against the seat, but such motion is not necessarily included in collapsible chairs. U.S. Pat. No. 3,124,387 to Maclaren (March 1964) depicts an early collapsible chair in which the seat and back are formed from a continuous piece of fabric. These are so-called sling type chairs. There have been many other designs over the years, including hinged lawn chairs such as that described in U.S. Pat. No. 4,715,650 to Berman et al. (December 1987), and U.S. Pat. No. 5,058,950 to Mann (October 1991).

Approximating the legs, seat frame, and back is a relatively complicated business, primarily because in the open disposition, the seat must be more or less perpendicular to both the legs and the back. Rocking chairs add rockers as yet additional perpendicular elements, which increase the complexity still further. This may be why rocking chairs are widely known to fold, but only rarely known to be collapsible. One reference that does describe a collapsible rocking chair is U.S. Pat. No. 4,685,725 to Helfrich (August 1987). Helfrich collapses his rocking chair by pivoting the rockers B, B' against all four legs of the chair, (see specification at col. 10, lines 55–60, and FIGS. 16, 50, 51). Unfortunately, that solution yields a very bulky product because much of the length of the rockers necessarily extends out beyond the legs in the collapsed disposition.

Thus, there is a continuing need to provide novel methods and apparatus for collapsible rocking chairs.

SUMMARY OF THE INVENTION

The present invention provides methods and apparatus in which a collapsible rocking chair has legs that translate towards and away from each other to configure the chair between open and collapsed dispositions, and at least one leg that slidably articulates with a rocker.

Preferred embodiments have four legs. The left back leg slidably articulates with a left rocker, and the right back leg slidably articulates with a right rocker. The front legs are pivotally coupled to the respective rockers at fixed points. The back frame is preferably coupled to the left and right legs at pivots, allowing the back to approximate the seat during folding. Both back and seat are preferably formed from a fabric material, and more preferably from a single continuous piece of fabric. Preferred rocking chairs also include left and right armrests, supported at least in part by the back frame.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

FIG. 4 is a side view of the collapsible rocking chair of FIG. 1.

FIG. 5 is a side view of the collapsible rocking chair of FIG. 1 in a collapsed disposition.

DETAILED DESCRIPTION

Figure 1:
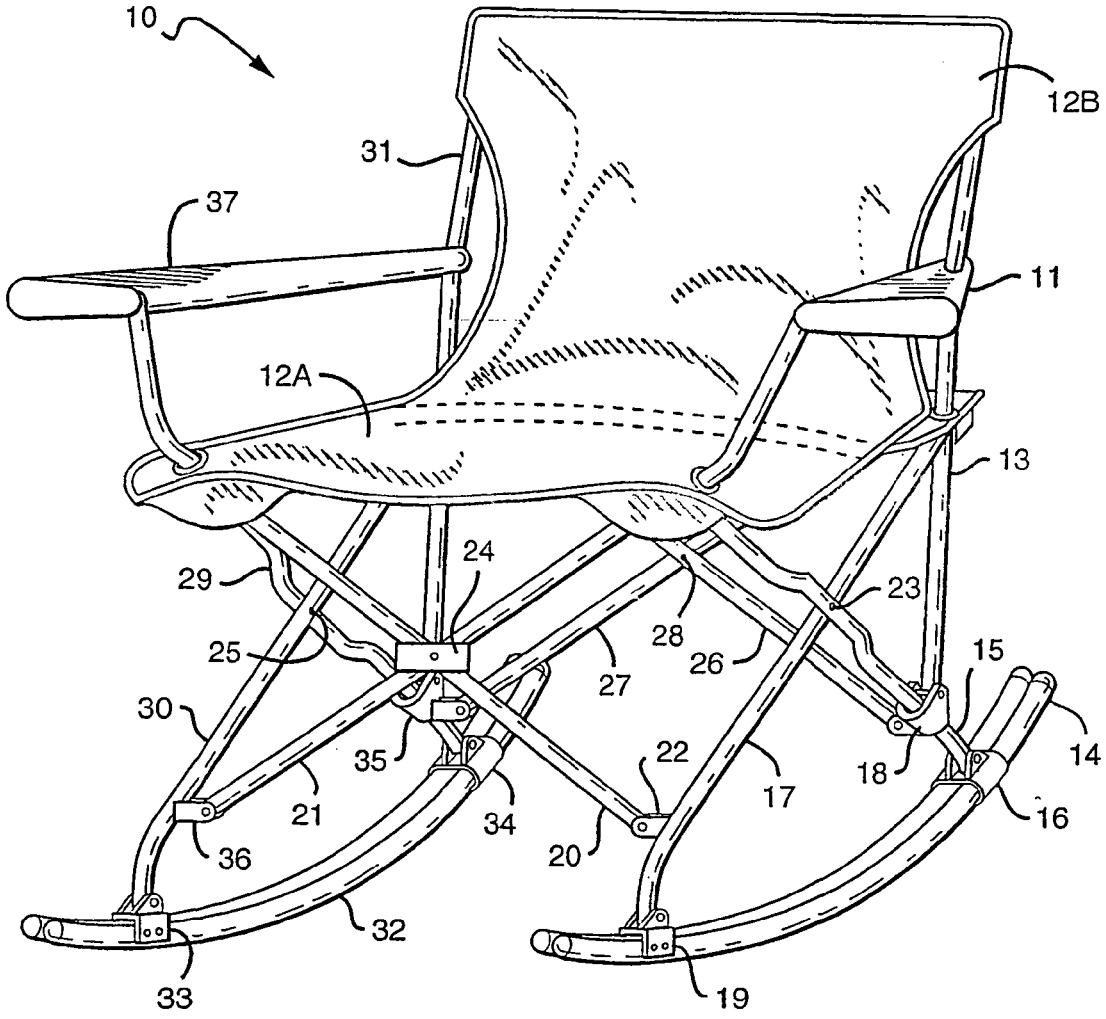
FIG. 1 is a perspective view of a collapsible rocking chair according to a preferred embodiment.
Figure 2:
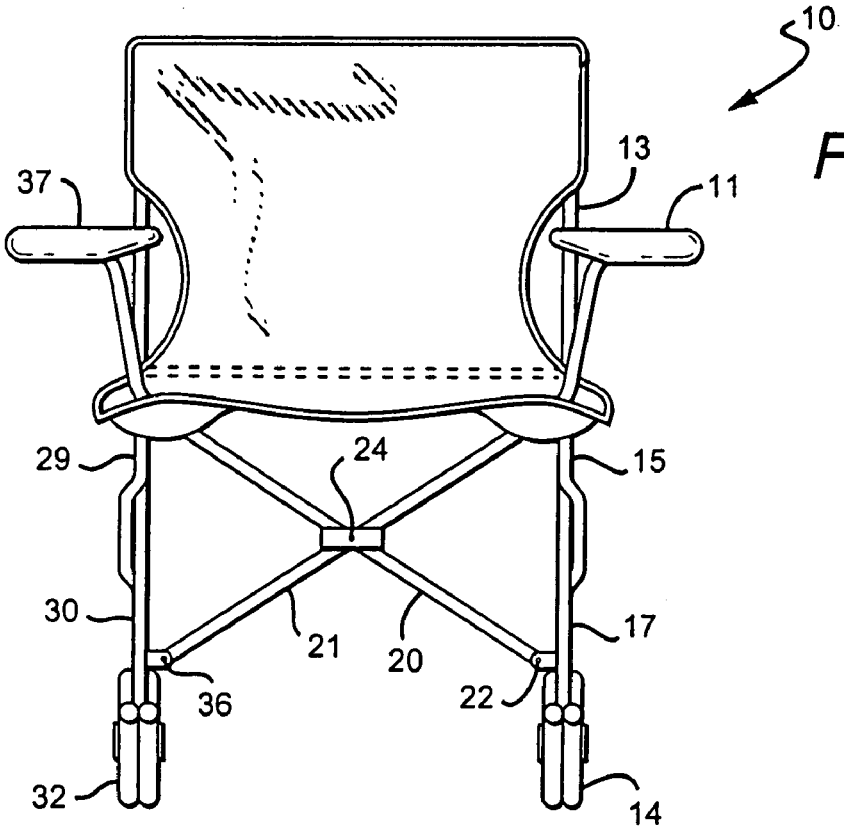
FIG. 2 is a front view of the collapsible rocking chair of FIG. 1.
Figure 3:
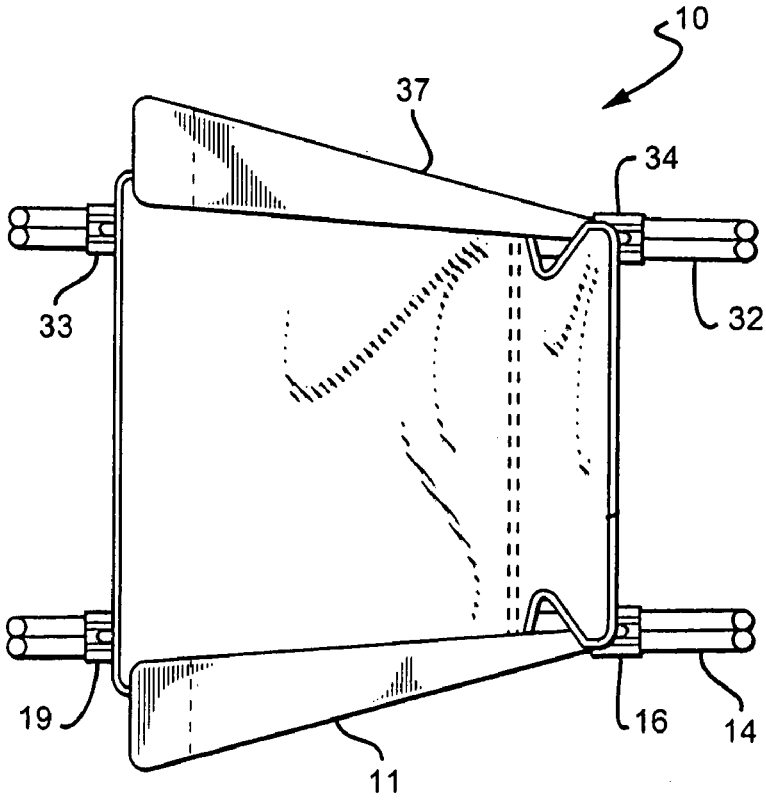
FIG. 3 is a top view of the collapsible rocking chair of FIG. 1.

In FIGS. 1–4 a rocking chair 10 generally has a seat 12A, a back 12B, arms 11, 37, legs 15, 17, 29, 30, leg support frame elements 20, 21, 26, 27, and back support frame elements 13, 31.

The seat 12A is positioned by back frame elements 13 and 31, legs 15, 17, 29, 30, and leg support frame elements 20, 21, 26, 27. The back 12B is positioned by back frame elements 13 and 31, legs 17, 30, and leg support frame elements 26, 27. The seat 12A and back 12B are both advantageously made from a material that is very flexible, while having sufficient strength and durability to accommodate expected use. It is especially useful if the material dries rapidly, and is relatively easy to clean. Preferred materials include natural material fabrics such as processed cotton, rayon, and so forth, as well as plastic or other synthetic materials, including rip stop nylon. One or both of the seat 12A and back 12B may be colored in an interesting pattern, or contain some sort of logo or other image. In particularly preferred embodiments the seat 12A and back 12B are portions of the same piece of material, and form a sling type seatback. Dimensions are contemplated to be ordinary dimensions for a rocking chair, where the seat 12A is about one and a half to three two feet off the ground, and between one and a half to two feet both in width and depth.

The back support frame elements 13, 31 are movable towards and away from each other by pivoting of the corresponding legs about pivots 24, 28. The back support frame elements 13, 31 must, of course, be strong enough to keep the back 12B from bending excessively when a person leans back in the chair 10.

The leg support frame elements 20, 21 are joined by an intermediate pivot 24, and the leg support frame elements 26, 27 are joined by another intermediate pivot 28. Pivots 24, 28 are considered to be intermediate because they are disposed between the ends of the joined frame elements, rather than at their ends. Left legs 15, 17 are joined by pivot 23, and right legs 29, 30 are joined by pivot 25. Other pivots 18, 22, 24, 28, 35, 36 couple elements as shown in the figures.

It will thus be appreciated that a collapsible rocking chair may advantageously comprise: a seat supported at least in part by a left leg and a right leg, at least one of which is slidably articulated with a rocker; wherein the left and right legs are coupled by a frame that accommodates translation of the left and right legs towards and away from one another. Additional legs are contemplated, including at least one additional leg that is not slidably articulated with the rocker. While it is contemplated to have a chair with other than 4 legs, and even a four legged chair in which the sliding legs are in the front rather than in the back, it is especially preferred that the chair have four legs, in which the left and rights back legs are slidably articulated with the left and right rockers, respectively, and the left and right front legs are pivotally coupled to the left and right rockers at a joint that is not movable, or at least not readily movable with respect to the left and right rockers, respectively. Nevertheless, in alternative embodiments one or both of the front legs may also be slidable with respect to the rockers. In other alternative embodiments the chair need not be symmetrical with respect to a vertical plane passing front to back through the center of the chair.

The various legs and support frame elements can be made of any suitable material, and preferably a material that is both strong and lightweight. Aluminum and stainless steel are preferred for these reasons, although wood, plastics, composites, and other materials are also contemplated. Materials that do not rust, or at least are rust resistant, are preferred. The legs and support frame elements are of suitable lengths to produce desirable overall dimensions of the chair 10. They are also preferably round and hollow to achieve desirable strength to weight ratios, although other cross-sectional shapes such as oblong or rectangular are also contemplated. Protective and/or decorative coatings are also contemplated.

The back legs 15, 29, are slidably articulated with rockers 14, 32 at sliding articulations 16, 34, respectively. The front legs 17, 30 are not slidably articulated with the rockers, and are instead pivotally coupled to the rockers 14, 32 at joints 19, 33, respectively. Although it is contemplated that any of the back and front legs may be releasably engaged with the respective rockers, in preferred embodiments the all of the legs are non-releasably engaged with the respective rockers The various pivots 18, 19, 22, 23, 24, 25, 28, 33, 35, 36, as well as sliding articulations 16, 34, may comprise any suitable materials or combinations of materials, including metals, plastics, composites, and so forth. Plastics with plastic or metal pins are especially preferred. Preferred pivots are engineered to withstand expected weight loads, repeated movement, and to operate satisfactorily in sandy or dirty environments without lubrication or excessive cleaning.

In terms of support, the drawings should be interpreted herein such that the seat is supported by the left and right legs, and the left and right armrests are supported at least in part by the back frame.

FIG. 5 depicts the collapsible rocking chair 10 in a collapsed. This is achieved by sliding the sliding articulations 16, 34 along rockers 14, 32 toward rocker pivot joints 19, 33, respectively. This in turn causes the left and right pairs of legs 15, 17 and 29, 30 to pivot against each other at pivots 23, 25, respectively. The chair 10 can then be further collapsed by pushing the left legs 15, 17 and right legs 29, 30 towards each other. An interesting aspect of FIG. 5 is that it shows that in the collapsed disposition, the legs 13, 15, 17, 20 do not extend out lengthwise beyond the rocker 14.

In operation, a preferred rocking chair is thus configurable between an open disposition in which the left and right rockers are disposed substantially under the left and right legs, respectively, and a collapsed disposition in which the left and right legs do not extend lengthwise beyond the left and right rockers. Viewed from another perspective, the rocking chair 10 is preferably configurable between an open disposition in which the sliding articulation is relatively farther from the fixed position and a collapsed disposition in which the sliding articulation is relatively closer to the fixed position.

It should also be appreciated that a novel method of collapsing a rocking chair comprises: providing the chair 10 with a first leg 15 that slides against a rocker 14 at first joint 16; providing the chair with a second leg 17 that pivots against the rocker 14 at a second joint 19; and manipulating the chair in a manner that reduces a distance between the first and second joints. The method may advantageously also provide the first and second legs 15, 17 with a mutual pivot such as that depicted as pivot 23. In another aspect, a preferred method may provide the chair with a third leg 30, and a pivoting frame 20, 21 that couples the second and third legs, and pivoting the frame at pivot 24 to bring the second and third legs closer together. In another aspect, a preferred method may provide a back frame 13 that pivots against the first leg 15 at pivot 18.

Thus, specific methods and apparatus for collapsible rocking chairs have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A collapsible rocking chair comprising:

a seat supported at least in part by a left leg and a right leg, wherein the left leg is slidably articulated with a left rocker, and the right leg is slidably articulated with a right rocker;

wherein the left and right legs are coupled by a frame that accommodates translation of the left and right legs towards and away from one another such that the chair collapses in a side-to-side motion;

wherein the seat moves along the frame when the left and right legs move towards and away from one another; and wherein the chair is configurable between an open disposition in which the left and right rockers are disposed substantially under the left and right legs, respectively, and a collapsed disposition in which the left and right legs do not extend lengthwise beyond the left and right rockers.

2. The rocking chair of claim 1 further comprising at least one additional leg that is not slidably articulated with the rocker.

3. The rocking chair of claim 1 further comprising a fabric seat supported by the left and right legs.

4. The rocking chair of claim 1 further comprising at least one additional leg that is not slidably articulated with any of the rockers.

5. The rocking chair of claim 1 further comprising at least one additional left leg that is pivotally coupled to the left rocker, and not slidably articulated with any of the rockers.

6. The rocking chair of claim 1 further comprising a back frame having a left side and a right side that are movable towards and away from each other.

7. The rocking chair of claim 1 wherein the frame coupling the left and right legs comprises at least two members coupled at an intermediate pivot.

8. The rocking chair of claim 1 wherein the left leg is slidably articulated with the left rocker at a sliding articulation, and another left leg is pivotally coupled with the left rocker at a fixed position.

9. The rocking chair of claim 8 wherein the chair is configurable between an open disposition in which the sliding articulation is relatively farther from the fixed position and a collapsed disposition in which the sliding articulation is relatively closer to the fixed position.

10. The rocking chair of claim 1 further comprising a back frame coupled to the left leg at a first pivot and the right leg at a second pivot.

11. The rocking chair of claim 10 further comprising a fabric back positioned by the back frame.

12. The rocking chair of claim 11 further comprising a fabric seat supported by the left and right legs, and continuous with the fabric back.

13. The rocking chair of claim 12 further comprising left and right armrests supported at least in part by the back frame.

14. A collapsible rocking chair comprising:

a seat supported at least in part by a left leg and a right leg, wherein the left leg is slidably articulated with a left rocker, and the right leg is slidably articulated with a right rocker;

wherein the left and right legs are coupled by a frame that accommodates translation of the left and right legs towards and away from one another such that the chair collapses in a side-to-side and front-to-back motion when (a) the left and right legs pivot towards the left and right rockers, respectively, and (b) the seat moves along the frame.

15. A method of collapsing a rocking chair, comprising:

providing the chair with a seat, a back, and a first leg that slides against a rocker at a first joint;

providing the chair with a second leg that pivots against the rocker at a second joint; and manipulating the chair in a manner that (a) reduces a distance between the first and second joints and (b) pivots the back towards the rocker to thereby collapse the chair in a side-to-side collapsing motion when the seat approximates the back.

16. The method of claim 15, further comprising:

providing the chair with a back frame that pivots against the first leg.

17. The method of claim 15, further comprising providing the first and second legs with a mutual pivot.

18. The method of claim 15, further comprising:

providing the chair with a third leg, and a pivoting frame that couples the second and third legs, and pivoting the frame to bring the second and third legs closer together.

* * * * *